United States Patent [19]

Klein et al.

[11] 4,062,589

[45] Dec. 13, 1977

[54] CHAIR WITH CONTOURED SEAT

[76] Inventors: Gerhart P. Klein; Brigitte I. Klein, both of 45 Raymond St., Manchester, Mass. 01944

[21] Appl. No.: 711,172

[22] Filed: Aug. 4, 1976

[51] Int. Cl.[2] ..... A47C 1/12

[52] U.S. Cl. ..... 297/450; 297/440; 297/441

[58] Field of Search ..... 297/441, 443, 440, 444, 297/450, 457, 454

[56] References Cited

U.S. PATENT DOCUMENTS

| | | | |
|---|---|---|---|
| 1,762,622 | 6/1930 | Gray | 297/450 |
| 1,987,940 | 1/1935 | Levine | 297/457 |
| 2,722,967 | 11/1955 | Reinholz | 297/441 X |
| 2,771,122 | 11/1956 | Straub | 297/441 X |
| 2,823,737 | 2/1958 | Eriksen | 5/93 R X |
| 3,600,035 | 8/1971 | Vondrejs | 297/457 X |
| 3,640,576 | 2/1972 | Morrison et al. | 297/457 X |

*Primary Examiner*—James C. Mitchell
*Attorney, Agent, or Firm*—Cesari and McKenna

[57] ABSTRACT

A chair including a contoured seat supported within a boxlike base. The seat includes a peripheral tubular frame and flexible material covering the frame. The base includes a pair of spaced, upright side members having grooves formed in the counterfacing surfaces thereof to match the contour of the seat in edge profile. A pair of lateral spacer members are connected between the side members so the edges of the seat are captured in the grooves. The seat is thus suspended in the base to provide a comfortable, unobstructed sitting area.

9 Claims, 8 Drawing Figures

FIG. 4A
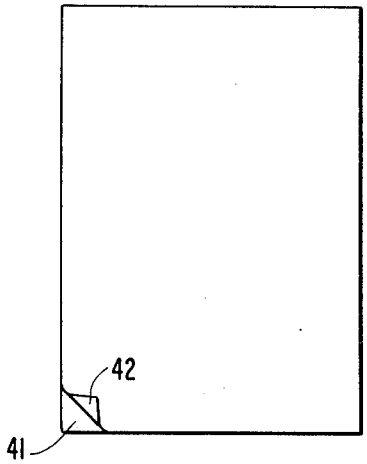
FIG. 4B
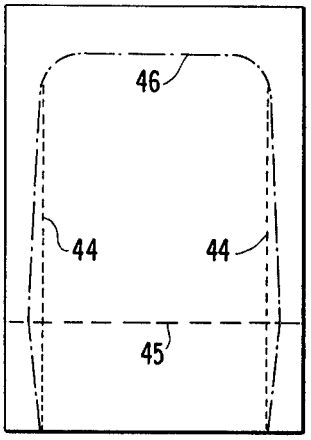
FIG. 4C
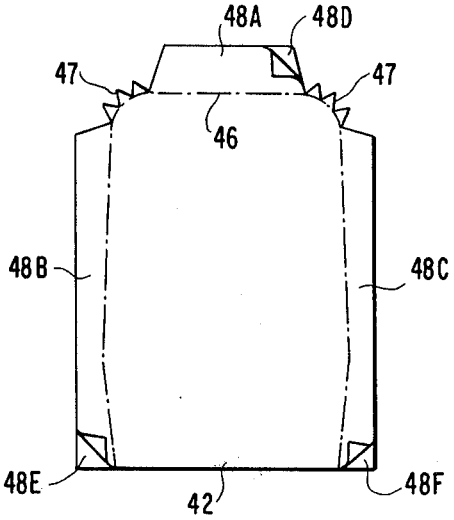
FIG. 4D
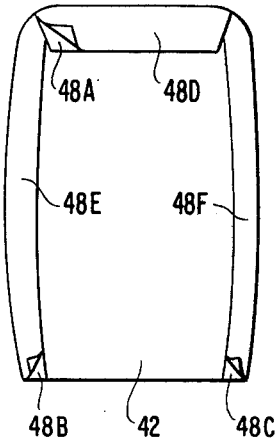
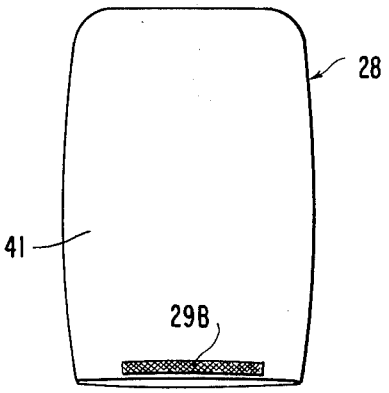
FIG. 4E

CHAIR WITH CONTOURED SEAT

BACKGROUND OF THE INVENTION

This invention generally relates to furniture construction and more specifically to the construction of chairs with contoured seats.

Various forms of chairs are available on the market. In many cases, the seat and backrest portions of the chairs are constructed from metal, molded plastic or other hard materials and are contoured to conform to the body surfaces of a user. Because these materials form an unyielding surface, chairs of this type often times do not provide particularly comfortable seating, especially when the chairs are to be occupied for extended periods of time.

To provide improved comfort flexible fabric materials are often utilized for the seat and backrest portion of chairs. For example, fabric panels are suspended between rigid frame members of wood or metal tubing in one type of construction. The edges of the panels are attached to the frame members by bolts, rivets, or by tab-like protrusions of the frame members.

Chairs of this type are generally more comfortable than hard surfaced chairs since the flexible fabric naturally adjusts to the body contours of each user seated therein. They are not, however, very durable. The fabric tends to pull away from the frame members when a person sits in such a chair. As a result, stress concentrations can occur at the points where fabric panels are attached to the frame members. Unless the fabric is reinforced at these points, it weakens with continued usage and eventually tears. Reinforcements in the form of additional layers of fabric, grommets or eyelets, can be sewn into the fabric panels during the manufacture of the chairs. Such reinforcements, however, add to the complexity and cost of manufacturing the chairs.

In another type of chair construction, a chair frame has spaced side members that support a fabric seat and back rest under tension. Tension is controlled by adjusting the length of lateral tensioning members that are disposed between the side members. As apparent, the addition of such tensioning members also increases the cost and complexity of the chairs.

Despite the recognized comfort provided by fabric chairs, their use to date has been rather limited. Most known constructions are in the form of informal furniture such as lawn and patio chairs and lounges. These chairs have, for the most part, lightweight and foldable frames and are not especially known for their strength and stability. Few, if any, of the known fabric chairs are considered attractive enough in appearance for everyday indoor usage.

It is, therefore, a general object of this invention to provide an improved article of furniture.

Another object of this invention is to provide a chair which is economical and simple to construct.

Yet another object of this invention is to provide a chair which combines a strong and stable base with a self-supporting seat.

Still another object of this invention is to provide a chair which includes a contoured fabric seat and which is both comfortable in use and attractive in appearance.

SUMMARY OF THE INVENTION

An article of furniture constructed in accordance with this invention includes a self-supporting seat that is, in edge profile, contoured to match the human anatomy. Grooves are formed in counterfacing surfaces of spaced, upright side members. These grooves conform to a position of the contoured seat in edge profile and capture the seat when the side members are properly spaced by spacer members.

In accordance with a more specific embodiment of this invention the article of furniture is a chair. The seat includes a two-piece fabric cover that is supported by a rigid frame disposed at the periphery of the seat. The side members and spacer members form a strong and stable box-like base. Grooves, formed into the counterfacing surfaces of each side member, capture the seat thereby to support portions of the tubular frame. The fabric seat is thus suspended within the base and provides a comfortable unobstructed sitting area that has no intermediate structural members.

The invention is pointed out with particularity in the appended claims. The foregoing and other features and advantages of the invention may be better understood by reference to the following detailed description taken in conjunction with the accompanying drawings.

BRIEF DESCRIPTION OF THE DRAWINGS

FIG. 4, comprising FIGS. 4A through 4E, illustrates the steps in the fabrication of a fabric cover used in the chair of FIGS. 1 and 2.

DETAILED DESCRIPTION OF AN ILLUSTRATIVE EMBODIMENT

Figure 1:
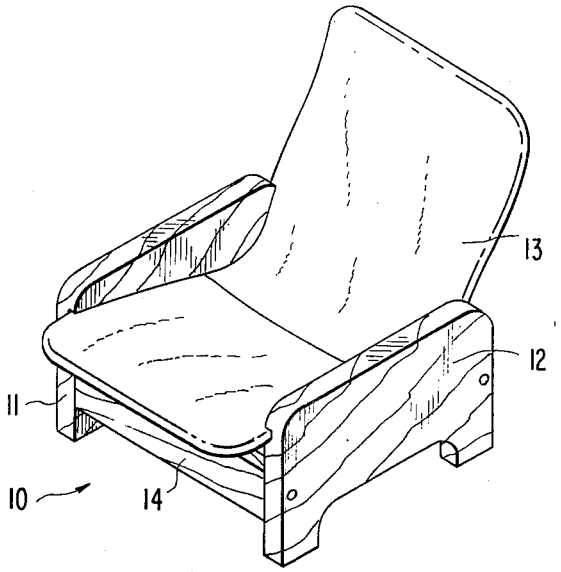
FIG. 1 is an assembled perspective view of a chair embodying the invention.

A chair 10 embodying this invention is shown in FIG. 1 in assembled form. The chair 10 includes side members 11 and 12 that support the edges of a contoured seat 13. The side members 11 and 12 are connected by a spacer member 14 at the front of the chair 10. An identical spacer member 15, which is shown in FIG. 2 but obscured in FIG. 1, connects the side members 11 and 12 at the rear of the chair 10.

Figure 2:
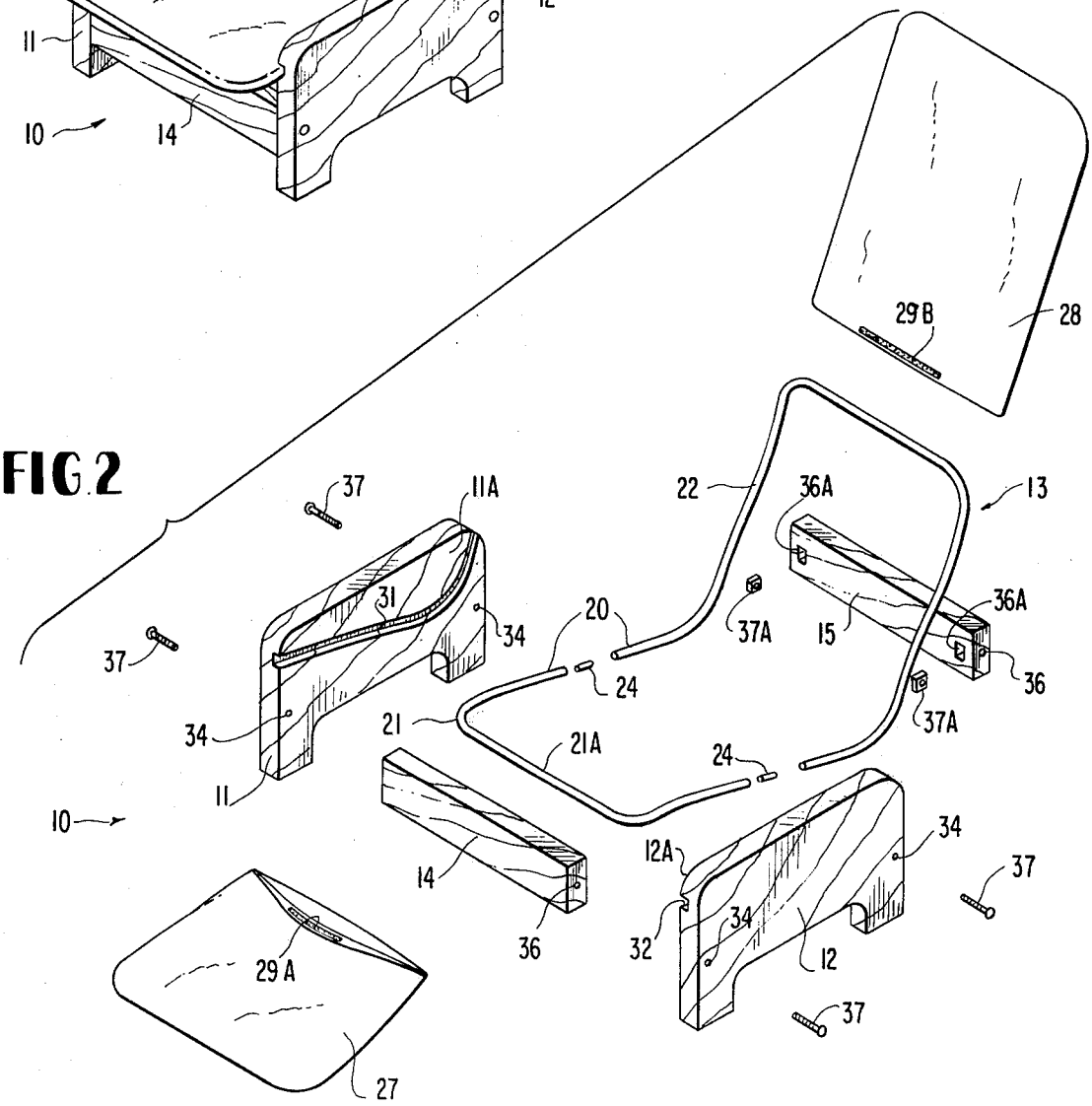
FIG. 2 is an exploded perspective view of the chair of FIG. 1 showing in more detail the various parts thereof.

Referring to FIG. 2, the contoured seat 13 includes a peripheral frame 20 that includes a pair of frame members 21 and 22. Each of the frame members 21 and 22 is preferably formed by bending metal tubing, such as conventional ¾ inch steel conduit. The abutting free ends of the frame members 21 and 22 are force fit onto dowel pins 24 thereby to provide an integral, tubular, peripheral frame.

A pair of fabric covers 27 and 28 are placed over the frame 20. Each cover is in the form of a bag that fits snugly over the opposite ends of the frame 20. On the frame 20, the cover 27 overlaps the cover 28. The covers 27 and 28 may then be suitably secured together to prevent slippage of the covers relative to the frame 20. Strips 29A and 29B of hook material and loop material may, for example, be attached to the inside edge of the cover 27 and the outside edge of the cover 28, respectively. These strips 29A and 29B allow the covers 27 and 28 to be removed from the frame 20 in the event that the chair 10 is to be disassembled for moving, storage, cleaning or repair. Such hook and loop materials are commercially available under the trademark "Velcro". Other types of fasteners might also be used to secure the covers 27 and 28 together.

As indicated in FIG. 2, the side members 11 and 12 and the spacer members 14 and 15 are assembled to form a box-like base for the seat 13. The counterfacing surfaces 11A and 12A of the side members 11 and 12 have formed thereat support means for the seat 13. In this embodiment, grooves 31 and 32 constitute the support means and conform to the contour of a portion of the seat 13 in edge profile. The seat 13 can thus be sandwiched between the side members 11 and 12 with the opposed edges of the frame 20 positioned within the grooves 31 and 32.

The spacer members 14 and 15 are secured between the side members 11 and 12 at the front and rear of the chair 10. Each spacer member 14 and 15 has a length which is equal to the width of the seat 13 minus the depth of both grooves 31 and 32. A through-hole 34 at the front and rear of each side member 11 and 12 is aligned with a matching hole 36 in each end of the spacer members 14 and 15. As indicated in FIG. 2, a pair of openings 36A is formed into the inside surface of the spacer member 15 to intersect with the holes 36. Although not shown in FIG. 2, an identical pair of openings 36A is formed into the inside surface of the spacer member 14. A fastening nut 37A may be inserted in each of the openings 36A and aligned with the hole 36. The side members 11 and 12 may thus be secured to the spacer members 14 and 15 by carriage bolts 37. Dowelling or other fastening techniques also can be used for this purpose.

Figure 3:
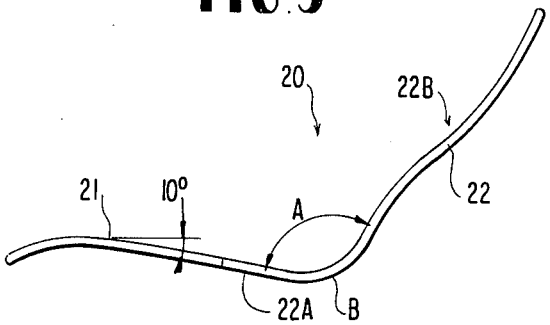
FIG. 3 is an edge view of a seat frame used in the chair of FIGS. 1 and 2.

FIG. 3 is an edge view of the frame members 21 and 22 that illustrates the contour thereof. It is noted that the frame member 22 is longer than the frame member 21. This locates the joint formed at the abutment of the members 21 and 22 within the grooves 31 and 32 in FIG. 2. In forming the frame member 22, a length of conduit is first bent into the shape of a planar "U" occupying a first plane. The end portions of the conduit are then bent at B to be in a second plane that intersects the first plane at an angle "A". The frame 22 is thus divided into a seat portion 22A and a back rest portion 22B. The angle "A" is chosen to provide a comfortable position and is in the range of 95° to 105°. Further comfort improvements also can be obtained by offsetting the upper and lower thirds of the back rest portion into spaced parallel planes. In one embodiment this offset is produced by bending the middle third of the back rest portion 22B to lie in an offsetting plane at an angle of about 25° with respect to the planes of the upper and lower thirds. The bottom third of the frame member 21 is also preferably bent downwardly so that it lies in an offsetting plane at an angle of about 20° with respect to the plane of the remaining two thirds thereof.

In a typical embodiment, the linear distance from the point B to the top of the frame member 22 is about 29 inches. The linear distance from the point B to the joints with the frame member 21 is about 12 inches. The linear distance from the point B to the bottom of the frame member 21 is about 23 inches. The width of the frame members 21 and 22 is about 24 inches. The radius of curvature of the bends at each corner of the frame members is about 6 inches.

The side members 11 and 12 and spacer members 14 and 15 are preferably formed of wood. The grooves 31 and 32 may be formed in the facing surfaces of side members using conventional routing, milling or other techniques. The depth of each groove 31 and 32 is made at least equal to the outside diameter of the conduit used in forming the frame 20.

The side members 11 and 12 are also preferably of sufficient height so that the upper surfaces thereof serve as armrests for the chair 10. Wood has been found useful for the side members 11 and 12 and spacer members 14 and 15 because it is attractive, strong and easily machined. Other materials, such as molded plastic or metal, also could be used.

The covers 27 and 28 are preferably formed from canvas. Canvas sheets can be readily stitched together to form bag-like shapes shown in FIG. 2. Canvas is also tough, tear resistant, low in cost and easily laundered. Of course, other fabrics also may be used. Moreover, an open mesh material might be used to improve ventilation.

We have found it desirable to provide an added amount of slack in the cover 28 in the vicinity of the bend B (FIG. 3) in the frame member 22. This extra slack has been found to minimize the lateral forces exerted on the sides of the frame 20 when the chair is occupied. It has also been found to add to the comfort of the chair. FIG. 4 illustrates the steps in a preferred method of fabricating a cover with this characteristic.

As indicated in FIG. 4A, we start with two identical sheets 41 and 42 of cover material, e.g., canvas. One sheet 42 is placed on top of the other sheet 41. The sheets are then stitched together along a line 46 which is shown in FIG. 4B.

In FIG. 4B, the dashed line 44 corresponds to the outline of the frame member 22. This outline 44 may be drawn on the sheet 42 as a temporary guide by tracing the frame member 22. The dashed line 45 in FIG. 4B corresponds to the bend B (FIG. 3) in the frame member 22. It is noted that the stitching line 46 deviates slightly from the outline of the frame member 22, with the maximum deviation occurring on the line 45. The resulting cover will thus have its greatest width along the line 45. The deviation is exaggerated in FIG. 4B for purposes of illustration. Typically, if the frame member 22 has an overall width of about 24 inches, the deviation will only be about ¼ inch at the line 45 at each side of the cover.

After stitching the sheets 41 and 42, several triangular portions are cut from the upper corners of the sheets, as indicated at 47 in FIG. 4C. This leaves selvages 48A, 48B and 48C extending from the upper sheet 42 and selvages 48D, 48E and 48F extending from the lower sheet 41. As indicated in FIG. 4D, the selvages 48A, 48B and 48C are folded along the line 46 and suitably secured to the body of the sheet 42, e.g., by stitching or by an adhesive. The selvages 48D, 48E and 48F are folded in the same direction and secured to the selvages 48A, 48B and 48C, respectively. The resulting structure is then turned inside out to yield the cover 28 illustrated in FIG. 4E. Preferably, the cover 28 is installed on the frame 20 so that the sheet 41 faces upwardly and the sheet 42 faces downwardly in the chair 10. Bulges in the cover 28 due to the folded selvages 48 are thus for the most part hidden from view. The strip 29B may then be attached along the edge of the sheet 41.

The cover 27 may be made in essentially the same manner illustrated in FIG. 4, however, using shorter sheets of cover material and the frame member 21 as a guide. Also, in stitching the cover 27, no deviations from the outline of the frame member 21 are made, except where it overlaps cover 28.

The extra slack provided in the cover 28 in the vicinity of the bend B in the frame member 22 favorably distributes the forces exerted on the frame 20 when the chair is occupied. The sides of the frame 20 are pulled together with a lesser force, while the top and bottom of the frame 20 are pulled together with a greater force. This adds to the stability of the chair 10 and minimizes the likelihood of the opposed side edges of the frame 20 being inadvertently pulled from the grooves 31 and 32 in the side members 11 and 12. It also adds to the comfort of the chair 10.

Thus, a chair constructed in accordance with the above embodiment of the invention has several attractive features. The chair 10 is both economical and simple to construct. It can readily be disassembled for moving, storage, cleaning or repair. The box-like base which supports the seat 13 is both strong and stable. The seat 13 is contoured and suspended in the base to provide a comfortable, unobstructed sitting area.

In addition, the chair 10 has a relatively attractive appearance and thus may be utilized in a wide variety of environments.

As will be apparent, the above described chair is illustrative only of one specific embodiment of the invention and can be modified in many ways by those skilled in the art. For example, the specific shape of the contoured seat 13 and specific design of the side members 11 and 12 and spacer members 14 and 15 may be varied to match any desired decor. Although grooves 31 and 32 in the side members 11 and 12 have been shown for the purpose of supporting the contoured seat 13, other methods of support, such as a ridge projecting from the facing surface of each member or discrete brackets, could be used. Additionally, for added comfort, cushions may be used loosely with or attached to the seat. We believe that these and other modifications are clearly within the true spirit and scope of the invention, and it is the object of the appended claims to cover all such variations and modifications.

What we claim as new and desire to secure by Letters Patent of the United States is:

1. An article of furniture comprising:

A. a seat that is contoured in edge profile;

B. spaced, upright side members including grooves formed in counterfacing surfaces thereof, said grooves conforming to the contour of a portion of said seat in edge profile; and C. means for spacing said side members so said seat is disposed in said grooves, said side members constituting the sole and direct support for said seat.

2. An article of furniture as recited in claim 1 wherein said seat consists of:

i. a peripheral frame, and ii. material surrounding said frame.

3. An article of furniture as recited in claim 2 in which said frame includes an intermediate bend defining the intersection of a seat portion and backrest portion of said seat and in which said material covering said frame is tapered to have a maximum width adjacent the bend.

4. An article of furniture as recited in claim 1 wherein said seat consists of:

i. tubular frame means that conforms to the peripheral configuration of said seat, and ii. flexible material cover means surrounding said frame.

5. An article of furniture as recited in claim 4 in which said tubular frame means comprises:

i. first and second generally U-shaped frame members, ii. dowel pin means for interconnecting the free ends of said frame members, and iii. said frame members in connected form having a contour which, in edge profile, conforms to the anatomy of a person in a seated position and which locates said dowel pin means in said grooves.

6. An article of furniture as recited in claim 4 in which said flexible material cover means comprises a first and second flexible bags having a width essentially equal to the width of same frame, said bags covering opposite portions of said frame.

7. An article of furniture as recited in claim 6 in which said first and second bags have respective lengths such that the ends of said bags overlap along an intermediate portion of said frame, said first and second bags further including means for removably securing the overlapped edges of said bags together.

8. An article of furniture as recited in claim 7 in which the width of said bags near the intermediate portion of said frame is slightly larger than the width of said frame so that extra slack is provided in an intermediate seat portion of said cover.

9. A chair comprising:

A. a seat including a rigid tubular frame that is contoured in edge profile and flexible material covering said frame;

B. first and second spaced, upright side members having grooves formed in the counterfacing surfaces thereof, said grooves conforming to the contour of a portion of said frame in edge profile; and C. first and second spacer members connected between said first and second side members at the front and rear of said chair, said spacer members having a length that enables said portions of said frame to be captured in said grooves and to be supported vertically therein, said side members constituting the sole and direct support for said seat.

* * * * *